US005435769A

United States Patent [19]

Bertrand

[11] Patent Number: 5,435,769

[45] Date of Patent: Jul. 25, 1995

[54] PLAY HOUSE FOR USE WITH CONSTRUCTION TOY BLOCKS

[75] Inventor: Victor J. Bertrand, Ile Bizard, Canada

[73] Assignee: The Ritvik Group Inc., Quebec, Canada

[21] Appl. No.: 73,080

[22] Filed: Jun. 8, 1993

[30] Foreign Application Priority Data

Feb. 2, 1993 [CA] Canada ..... 2088656

[51] Int. Cl.[6] ..... A63H 3/52

[52] U.S. Cl. ..... 446/476; 446/482

[58] Field of Search ..... 446/118, 128, 110, 476, 446/482; 434/72, 79

[56] References Cited

U.S. PATENT DOCUMENTS

| | | | |
|---|---|---|---|
| 1,551,666 | 9/1925 | Jensen et al. | 446/75 |
| 1,787,978 | 1/1931 | Gilmond | 446/478 |
| 2,523,508 | 9/1950 | Ledgett | 446/110 X |
| 4,018,001 | 4/1977 | Walmer | 446/110 X |
| 4,139,967 | 2/1979 | Kuna et al. | 446/476 X |
| 4,346,908 | 8/1982 | Kassai | 446/118 X |
| 5,015,210 | 5/1991 | Dideriksen | 446/128 |
| 5,055,083 | 10/1991 | Walker et al. | 446/478 |

FOREIGN PATENT DOCUMENTS

| | | | |
|---|---|---|---|
| 133178 | 5/1933 | Austria | 446/118 |
| 0030581 | 6/1981 | European Pat. Off. . | |
| 175314 | of 0000 | France . | |
| 175315-8 | of 0000 | France . | |
| 196767-8 | of 0000 | France . | |
| 246169 | of 0000 | France . | |
| 246170 | of 0000 | France . | |
| 246171 | of 0000 | France . | |
| 246183 | of 0000 | France . | |
| 246185 | of 0000 | France . | |
| 246190 | of 0000 | France . | |
| 267804 | of 0000 | France . | |
| 267808 | of 0000 | France . | |
| 307416 | of 0000 | France . | |
| 328616 | of 0000 | France . | |
| 328617 | of 0000 | France . | |
| 328636 | of 0000 | France . | |
| 328637 | of 0000 | France . | |
| 3303430 | 8/1984 | Germany . | |
| 2176125 | 12/1986 | United Kingdom | 446/118 |

OTHER PUBLICATIONS

"BOMBO" Barton Agencies, Ltd., Vancouver 3, B.C., Canada.

*Primary Examiner*—Mickey Yu

*Attorney, Agent, or Firm*—Michael D. Bednarek; Marks & Murase

[57] ABSTRACT

A play house for use by children to play with dolls or toy figurines. It has a base, a plurality of lateral walls and a roof which altogether define an openable enclosure externally shaped as a house. It also has one or more floor members within the enclosure, each of which has an upper surface provided with a plurality of identical connecting elements, preferably in the form of cylindrical studs, that extend upwardly therefrom. The connecting elements are sized and positioned to fit into, and retain construction toy blocks capable of being assembled with other construction toy blocks provided with the same connecting elements. Advantageously, the floor members are detachably mounted within the enclosure to allow the construction toy blocks to be assembled therewith outside the enclosure. This feature makes the play house easier to play with, as the child may remove the floor member, then build easily on it with the construction toy blocks, and finally reinsert the floor member with the built structure into the play house. This also makes it possible to easily interchange some already built floor members, if the child wants to interchange some of the rooms or pieces of furniture decorating the same, without having to dismantle them and construct them again.

20 Claims, 3 Drawing Sheets

PLAY HOUSE FOR USE WITH CONSTRUCTION TOY BLOCKS

BACKGROUND OF THE INVENTION 1. a) Field of the Invention

The present invention is concerned with an improvement to the structure of the play houses, also known as toy houses or doll-houses, that are used by children to play with dolls or toy figurines.

More particularly, the invention is concerned with a play house which is so devised as to be "playable" with construction toy blocks like those sold by the Applicant under the trade mark MEGA MICRO BLOCK ®, or those sold by other companies such as INTERLEGO A.G. and TYCO INDUSTRIES INC. under their trade marks LEGO ® and TYCO ®, respectively.

2. b) Brief Description of the Prior Art

Play houses for use by children to play with dolls or toy figurines, have been known for centuries, not to say millennia, and are still very popular.

Such play houses usually comprise a base, a plurality of lateral walls and a roof which altogether define an openable enclosure which is preferably externally shaped as a house. Usually, the enclosure is internally divided into "rooms" by means of floor member(s) and/or partition(s), each room being made and/or decorated like one of the rooms conventionally found in any "real" house, such as a living-room, a dining room, a bedroom, a kitchen, etc.

It is also of conventional practice to sell such play houses with toy furnitures to fill the rooms. These toy furnitures are usually copies, at a very reduce scale, of the pieces of furniture that can be found in a real house, such as tables, chairs, beds, cupboards, etc.

On the other hand, construction toy blocks like those sold under the above mentioned trade marks have been known for several decades and are still very popular. Such blocks which can be of different size, are used by children to construct different items according to their own imagination, eventhough models of construction are suggested by the manufacturers. The blocks which are usually parallelepipedic in shape, are provided with a plurality of identical connecting elements projecting from their top surfaces, which are sized to snugly fit and be frictionally held into cavities provided in the bottom surface of similar blocks. The connecting elements are usually in the form of cylindrical studs regularly distributed over the top surfaces of the blocks. For greater details on the structure of such blocks, reference can be made to U.S. Pat. No. 3,005,282 granted to INTERLEGO A.G.

OBJECT AND SUMMARY OF THE INVENTION

The object of the present invention is to provide a play house of the above mentioned type, which is so constructed and devised that it can be used with the existing construction toy blocks that are available on the market, thereby making it possible for a child to construct and place anywhere in the room(s) of his or her play house, any kind of furniture-shaped toy block or group of toy blocks. Such a possibility, Of course, increases the interest of both the play house and the construction toy blocks to the child, in addition to stimulating his or her creativity.

In accordance with the invention, the above object is achieved with an improved play house of the type comprising a base, a plurality of lateral walls and a roof which altogether define an openable enclosure externally shaped as a house, the play house also comprising at least one floor member within said enclosure, the improvement being that at least one and preferably more than one of the floor members have an upper surface provided with a plurality of identical connecting elements extending upwardly therefrom, the connecting elements being sized and positioned to fit into and retain construction toy blocks capable of being assembled with other construction toy blocks provided with the same connecting elements.

According to a particularly interesting and preferred embodiment of the invention, at least some of the floor members are detachably mounted within the enclosure to allow the construction toy blocks to be assembled therewith outside the enclosure. This feature makes the play house easier to play with, as the child may remove the floor member, then build easily on it with his or her construction toy blocks, and finally reinsert the floor member with the built structure into the play house. This also makes it possible to easily interchange some already built floor members, if the child wants to interchange some of the rooms or pieces of furniture decorating the same without having to dismantle them and construct them again.

According to another preferred embodiment of the invention, the play house comprises at least one vertical partition mounted within the enclosure. Advantageously at least some of the vertical partitions are detachably mounted within the enclosure.

To make them detachable, the detachably mounted floor members preferably have edges slidably insertable over supporting beads provided for this purpose onto the lateral walls and the partitions. Similarly, the detachably mounted partitions preferably have edges slidably insertable into groves provided for this purpose into the base, the lateral walls and the roof of the play house.

Some of floor members may also have bottom surfaces provided with other connecting elements to make it possible to hang thereto further construction blocks.

The invention and its advantages will be better understood upon reading the following non restrictive description of a preferred embodiment thereof, given with reference to the accompanying drawings.

DESCRIPTION OF A PREFERRED EMBODIMENT

Figure 1:
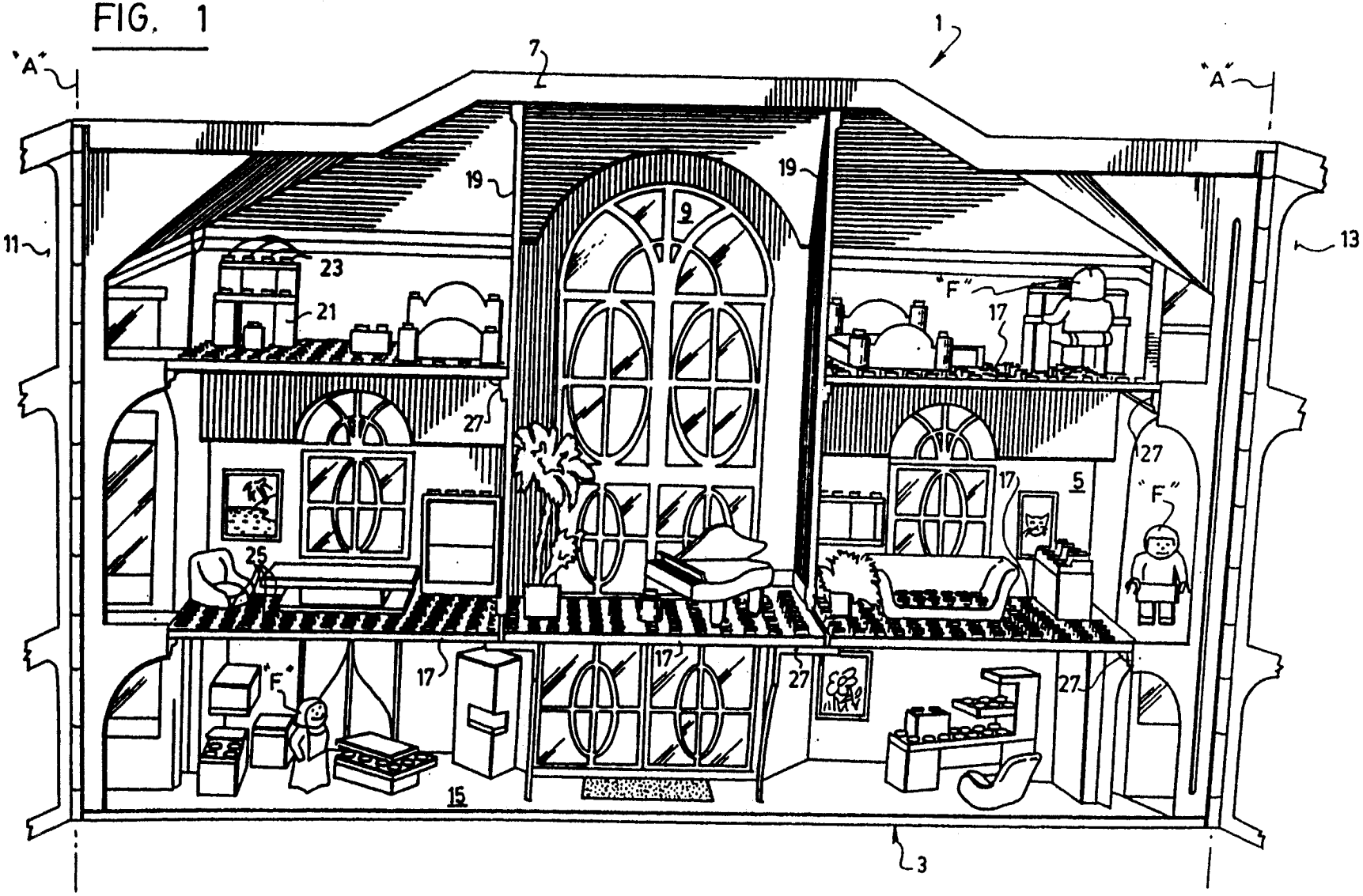
FIG. 1 is front perspective view of the central portion of a play house according to the invention, shown in fully opened position, with a plurality of furniture-shaped toy blocks and a few toy figurines.

The play house 1 according to the invention as shown in the accompanying drawings comprise a base 3, a plurality of lateral walls 5 and a roof 7 which altogether define an enclosure 9 which is externally shaped as a house. The enclosure 9 which is shown in opened position, is actually openable by pivotal of at least one of its lateral walls, viz its front wall that is made of two parts 11, 13 that are hingedly connected to the adjacent side walls so as to be pivotable about vertical axes A, A' to open the enclosure.

As is also shown, the enclosure is internally divided into stories, and the stories into "rooms" by means of floor members 15, 17 and/or partitions 19. Each room is advantageously made and/or decorated like one of the rooms conventionally found in any "real" house, such as a living-room, a dining room, a bedroom, a kitchen, etc. Each room may also comprise doors and windows, as is shown.

As is further shown, the play house 1 advantageously comprises toy furnitures to fill the rooms. These toy furnitures are usually copies at a very reduce scale, of the pieces of furniture that can be found in a real house. Of course, these toy furnitures are sized to fit into the rooms and be played with toy figurines specially designed for this purpose.

As was already explained hereinabove the play house 1 according to the invention distinguishes over those presently offered for sale in that is so constructed and devised that is can be used with construction toy blocks like those sold by the Applicant under the trade mark MEGA MICRO BLOCK®, thereby making it possible for a Child to construct any kind of furniture-shaped toy block or group of toy blocks and place them anywhere in the rooms of the play house. Such a possibility, of course, increases the interest of both the play house and the construction toy blocks to the child, in addition to stimulating his or her creativity.

To achieve this goal and thus make it possible to use the play house 1 with construction toy blocks like those one numbered 21, which are provided with a plurality of identical connecting elements 23 usually in the form of cylindrical studs that are regularly distributed over the top surfaces of the blocks and are sized to snugly fit and be frictionally held into cavities provided in the bottom surface of similar blocks, at least some of the floor members, viz those numbered 17, have an upper surface provided with a plurality of identical connecting elements 25 also in the form of cylindrical studs extending upwardly therefrom, the connecting elements 25 being sized and positioned to fit into and retain construction toy blocks like the one numbered 21.

Figure 2:
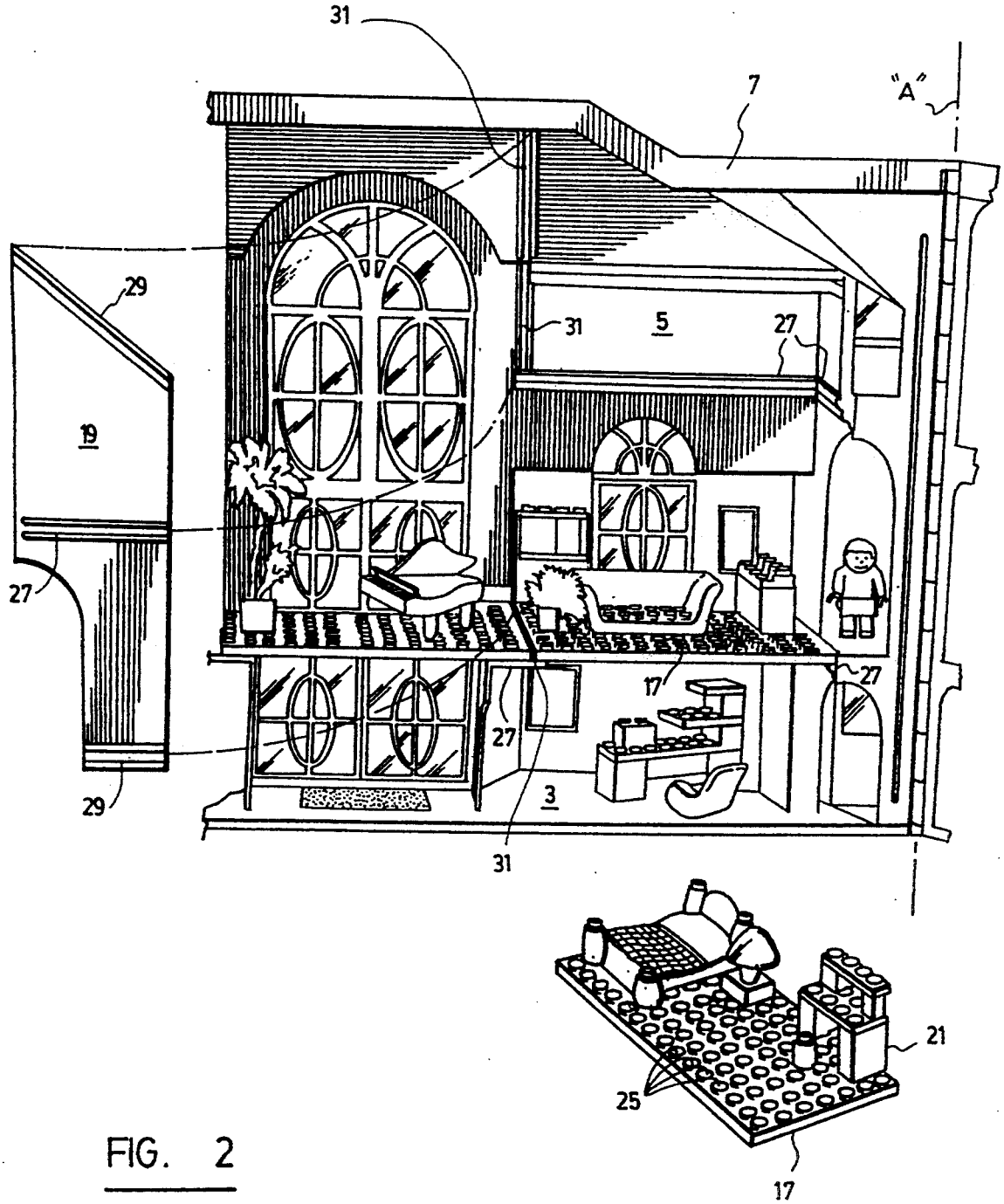
FIG. 2 is a perspective view of a portion of the play house shown in FIG. 1, showing one of the partitions and one of the floor members removed from their original positions.
Figure 3:
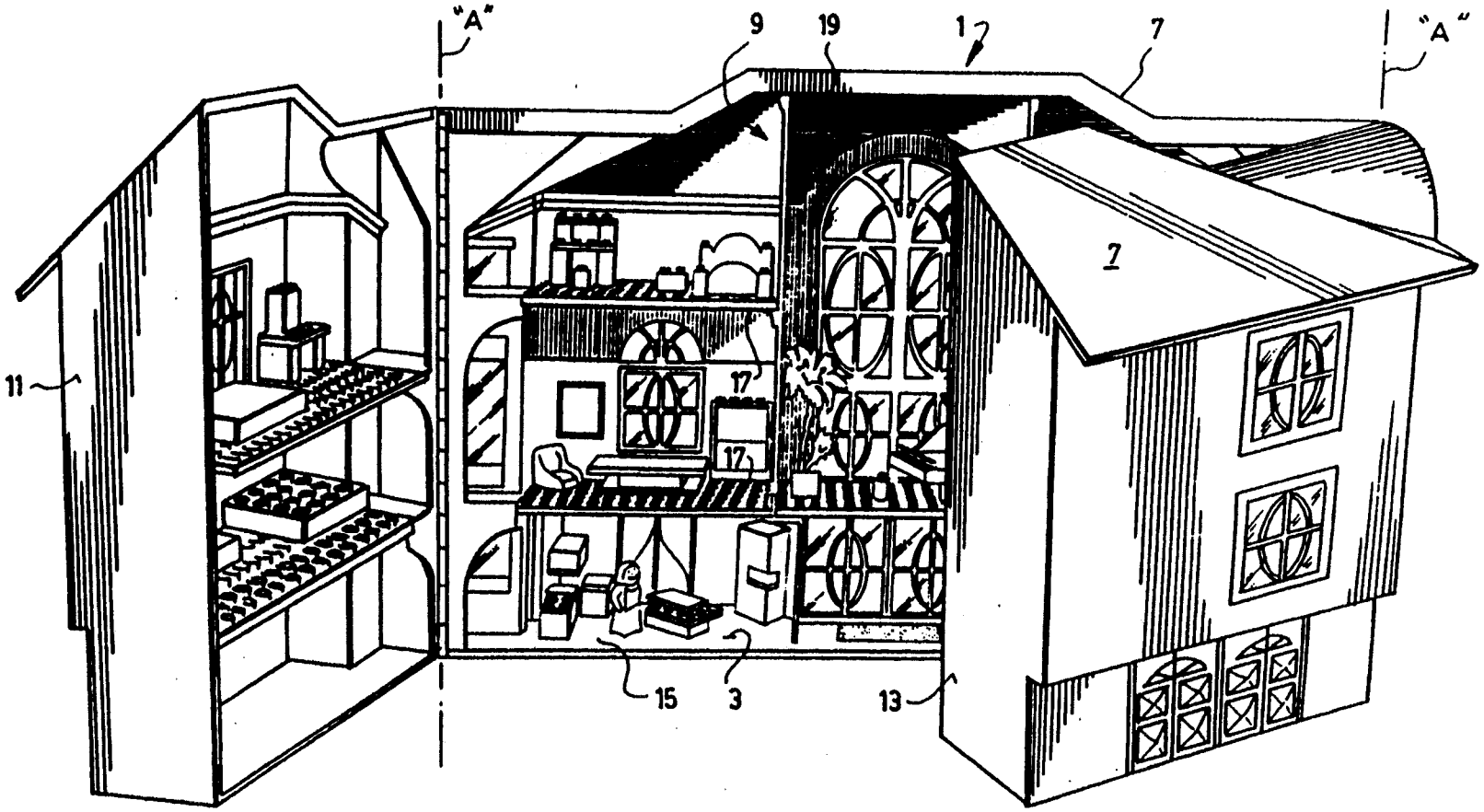
FIG. 3 is a perspective view of the play house shown in FIGS. 1 and 2, in semi-opened position.

According to a particularly interesting and preferred embodiment of the invention, the floor members 17 provided with the-connecting elements 25 on their upper surfaces, are detachably mounted within the enclosure 9 so to allow the construction toy blocks to be assembled therewith outside the enclosure. This feature which is shown in FIG. 2, makes the play house 1 easier to play with, as the child may remove the floor member 17, then build easily on it with his or her construction toy blocks 21, and finally reinsert the floor member with the built structure into the play house. This also makes it possible for the child to easily interchange some already built floor members 17, if he or she wants to interchange some of the rooms or pieces of furniture decorating the same without having to dismantle them and construct them again.

Advantageously also, one or more of the vertical partitions 19 can be detachably mounted within the enclosure.

To make them easily detachable, each of the floor members 17 has edges slidably insertable over supporting beads 27 provided for this purpose onto the lateral walls, and the partitions 19. For the very same purpose, each of the detachable partitions also has edges 29 slidably insertable onto groves 31 provided for this purpose into the base 3, the lateral walls 5 and the roof 7.

Some of floor members 17 may also have bottom surfaces provided with female connecting elements as is known per se, to make it possible to hang thereto further construction blocks like chandelier-shaped blocks.

The play house 1 described hereinabove can be made of any kind of material and be of any shape and size. However it is preferably made of plastic material and sized to be easily carried by a child, say a 6 to 8 years old child. For this purpose, it may be provided with a handle on its roof and with means such as a key to lock it closed.

Of course, numerous other modification could be made to the above described play house without departing from the scope of the present invention, as defined in the appended claims. Thus, by way of examples, other means could be provided to make some of the floor members and partitions easily detachable, such as locking pegs integrally projecting from the edges of the floor members to engage corresponding holes made for this purpose in the lateral walls or partitions. Similarly, the connecting elements need not be cylindrical in shape and could be of other design.

I claim:

1. In a playhouse comprising a base, a plurality of lateral walls and a roof which altogether define an openable enclosure externally shaped as a house, said play house also comprising at least one floor member within said enclosure, the improvement wherein said at least one floor member has an Upper surface provided with a plurality of connecting elements extending upwardly therefrom, said connecting elements being sized and positioned to fit into and retain construction toy blocks capable of being assembled with other construction toy blocks provided with connecting elements so as to form pieces of furniture inside said play house; wherein said at least one floor member is detachably mounted within said enclosure to allow said construction toy blocks to be assembled therewith outside said enclosure; and further comprising at least one vertical partition mounted within said enclosure and wherein said at least one vertical partition is detachably mounted within said enclosure, such that the vertical partition may be removed from the enclosure without removing any other piece of the play house.

2. The improved play house of claim 1, wherein each of said at least one detachably mounted partition has edges slidably insertable into grooves provided for this purpose into one or more of said base, said lateral walls and said roof.

3. In a playhouse comprising a base, a plurality of lateral walls and a roof which altogether define an openable enclosure externally shaped as a housing structure, said play house also comprising at least one floor member within said enclosure, the improvement wherein said at least one floor member has an upper surface provided with a plurality of connecting elements extending upwardly therefrom, said connecting elements being sized and positioned to fit into and retain construction toy blocks capable of being assembled with other construction toy blocks provided with connecting elements so as to form pieces of furniture inside said play house; wherein said at least one floor member is detachably mounted within said enclosure to allow said construction toy blocks to be assembled therewith outside said enclosure; and further comprising at least one vertical partition mounted within said enclosure and wherein said at least one detachably mounted floor member has edges slidably insertable over supporting beads projecting from at least two of said lateral walls and said at least one partition such that the floor member may be removed from the enclosure without removing any other piece of the play house.

4. The improved play house of claim 3, wherein said connecting elements consists of a plurality of cylindrical studs regularly spaced apart and capable of being inserted and frictionally held into cavities provided under said construction toy blocks.

5. The improved play house of claim 4, said house comprising two stories, wherein some of said at least one floor member have a lower surface provided with other connecting elements to make it possible to hang thereto further construction blocks.

6. The improved play house of claim 5, wherein at least one of said lateral walls is hingedly connected to another adjacent wall so as to be pivotable about a vertical axis to open said enclosure.

7. A play house adapted for use with construction toy blocks, the play house comprising: a base; a plurality of lateral walls; and a roof which together define a play house having a facade shaped as a house; the play house comprising a plurality of rooms accessible from the back of the play house, each of the rooms having a floor and at least one of the rooms having a floor section having an upper surface provided with a plurality of identical connecting elements extending upward from the floor section, wherein the floor section provided with connecting elements is detachably mounted within the play house in a way that permits removal of the floor section without removing any other piece so as to allow construction toy blocks to be assembled onto the floor section outside the play house.

8. The play house of claim 7, further comprising a plurality of pieces of toy furniture secured to the floor section having projecting elements, each of the pieces of furniture being constructed from a plurality of toy construction blocks, the toy construction blocks each comprising a plurality of connecting elements on one face and a plurality of complimentary connecting elements on the opposite face, wherein the connecting elements of the construction blocks can be secured to the floor section having projecting elements.

9. The play house of claim 7, comprising two floor sections provided with connecting elements and detachably mounted within the play house so as to be supported horizontally at the same vertical level such that the floor sections define the floors of two separate rooms located on the same level of the play house, thereby permitting the removal of the floor of one room without disturbing the floor of another room.

10. The play house of claim 9, further comprising a third floor section provided with connecting elements and detachably mounted within the play house at the same level as the first and second floor sections.

11. The play house of claim 7, wherein the play house comprises two play house sections which are pivotably secured to one another, each play house section including a base, a plurality of lateral walls and a roof, the two play house sections comprising at least part of an openable enclosure.

12. The play house of claim 11, wherein each of the two playhouse sections includes a floor section provided with connecting elements and detachably mounted within the play house in a way which permits removal of the respective floor section without removing any other piece to allow construction toy blocks to be assembled onto the floor section outside the play house.

13. The play house of claim 11, further comprising a third play house section which is pivotably secured to one of the other two play house sections, the third play house section including a base, a plurality of lateral walls and a roof.

14. The play house of claim 7, wherein the roof has a longitudinal centerline and the play house is split into play house sections along the longitudinal centerline, such that the play house comprises at least two play house sections each having rooms and wherein at least two play house sections are pivotably connected to one another.

15. The play house of claim 7, wherein the floor section provided with connecting elements further comprises a lower surface provided with connecting elements which are different from, but engageable with, connecting elements of the type provided on the upper surface so as to permit attachment of toy construction blocks to said lower surface.

16. A play house adapted for use with construction toy blocks, the play house comprising: a base; a plurality of lateral walls; and a roof which together define a play house having a facade shaped as a housing structure; the play house comprising a plurality of rooms accessible from the back of the play house, each of the rooms having a floor and at least one of the rooms having a floor section having an upper surface provided with a plurality of identical connecting elements extending upward from the floor section, each floor section having a floor size corresponding to the floor size of a single room such that each of the floor sections of the plurality of rooms comprise the entire floor area of one and only one room and whereby all floor sections of the plurality of rooms are of the same size and are mounted such that the floor sections of each of the plurality of rooms may be removed without disturbing the floor section of any other room and whereby the floor section of one of the plurality of rooms may be interchanged with the floor section of another of the plurality of rooms.

17. The play house of claim 16, wherein at least two of the plurality of rooms are located on the same level of the play house.

18. The play house of claim 16, wherein at least two of the plurality of rooms are located at different levels within the play house.

19. The play house of claim 16, wherein at least two of the plurality of rooms are located in sections of the play house which are movable with respect to one another.

20. The play house of claim 16, further comprising at least one removable vertical partition which separates at least two rooms from one another, the vertical partition being detachably mounted to the play house such that the vertical partition may be removed without removing any other piece of the play house.

* * * * *